US006491470B1

(12) United States Patent
Gertz

(10) Patent No.: US 6,491,470 B1
(45) **Date of Patent: *Dec. 10, 2002**

(54) INERTIAL BARRIER MODULE

(75) Inventor: David C. Gertz, San Clemente, CA (US)

(73) Assignee: Traffix Devices, Inc., San Clemente, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/480,823

(22) Filed: Jan. 10, 2000

(51) Int. Cl.[7] ..... E01F 9/00; E01F 13/00
(52) U.S. Cl. ..... 404/6; 404/9; 404/10
(58) Field of Search ..... 404/6, 9, 10; 256/13.1

(56) References Cited

U.S. PATENT DOCUMENTS

| | | | | | |
|---|---|---|---|---|---|
| 3,606,258 | A | | 9/1971 | Fitch | |
| 3,674,115 | A | | 7/1972 | Young et al. | |
| 3,856,268 | A | | 12/1974 | Fitch | |
| 3,916,816 | A | | 11/1975 | Fitch | |
| 4,071,599 | A | | 1/1978 | Walker | |
| 4,072,334 | A | | 2/1978 | Seegmiller et al. | |
| 4,073,482 | A | | 2/1978 | Seegmiller et al. | |
| 4,097,572 | A | | 6/1978 | Walker | |
| 4,183,504 | A | * | 1/1980 | Ford | 256/13.1 |
| 4,289,419 | A | | 9/1981 | Young et al. | |
| 4,452,431 | A | | 6/1984 | Stephens et al. | |
| 4,557,466 | A | | 12/1985 | Zucker | |
| 4,583,716 | A | | 4/1986 | Stephens et al. | |
| 4,607,824 | A | | 8/1986 | Krage et al. | |
| 4,635,981 | A | | 1/1987 | Friton | |
| 4,645,375 | A | * | 2/1987 | Carney, III | 404/6 |
| 4,666,130 | A | | 5/1987 | Denman et al. | |
| 4,688,766 | A | | 8/1987 | Zucker | |
| 4,711,481 | A | | 12/1987 | Krage et al. | |
| 4,784,515 | A | | 11/1988 | Krage et al. | |
| 4,934,661 | A | | 6/1990 | Denman et al. | |
| 5,002,423 | A | | 3/1991 | Mileti | |
| 5,011,326 | A | * | 4/1991 | Carney, III | 404/6 |
| 5,088,874 | A | | 2/1992 | Quittner | |
| 5,112,028 | A | | 5/1992 | Laturner | |
| 5,125,762 | A | * | 6/1992 | Strassil | 404/6 |
| 5,192,157 | A | | 3/1993 | Laturner | |
| 5,211,503 | A | | 5/1993 | Quittner | |
| 5,306,106 | A | | 4/1994 | Mileti | |
| 5,314,261 | A | | 5/1994 | Stephens | |
| 5,403,112 | A | * | 4/1995 | Carney, III | 404/6 |
| 5,425,594 | A | | 6/1995 | Krage et al. | |
| 5,927,896 | A | | 7/1999 | Gertz | |
| 6,203,241 | B1 | * | 3/2001 | Gertz | 404/6 |

* cited by examiner

*Primary Examiner*—Gary S. Hartmann
(74) *Attorney, Agent, or Firm*—Stout, Uxa, Buyan & Mullins, LLP

(57) ABSTRACT

An inertial barrier system comprises inertial barriers formed of two modules, each of them being differently sized and being adapted to stack one upon the other. An interlocking geometry on each of the mating ends of modules assists in obtaining a secure stacking arrangement. One of the two modules functions as a container, facing upwardly so that its volumetric capacity is available for filling by a particulate ballasting material. The lower module functions only as a pedestal for the support of the upper module. The upper module is fillable to different predetermined levels, so that the apparatus, comprising the joined lower and upper modules, is capable of functioning as differently weighted barrier systems.

21 Claims, 4 Drawing Sheets

INERTIAL BARRIER MODULE

This application is related to co-pending patent application Ser. No. 09/282,699, entitled Inertial Barrier Module, filed on Mar. 31, 1999, which is a continuation of patent application Ser. No. 08/989,545, filed on Dec. 12, 1997, now issued as U.S. Pat. No. 5,927,896, which patent is herein expressly incorporated by reference.

BACKGROUND OF THE INVENTION

This invention relates to traffic safety equipment, and more particularly to an inertial barrier system for attenuating the energy of errant vehicles.

Inertial highway barriers have been used for some time to prevent vehicles from striking an obstacle such as a bridge pier or the like at full velocity. An inertial barrier relies on the mass of the barrier to decelerate the vehicle. Typically, a dispersible material such as sand is enclosed in a frangible container. When the vehicle strikes the container, the momentum of the impacting vehicle is dissipated in accelerating the sand.

In the current state of the art, standard arrays of sand-filled energy absorbing units are employed, with the amount of sand varying from one barrier unit to the next in a predetermined fashion so that an errant vehicle crashing into the barrier system is decelerated with minimum damage to the vehicle and its occupants. Because the plastic containers for these units are shatterable if struck at highway speeds, the effect of the barrier on stopping the errant vehicle comes about by transfer of momentum of the vehicle to the sand or other dispersible particulate medium. By arranging the barrier units, in order of striking, from lighter to heavier in terms of amount of sand contained therein, the errant vehicle can be caused to decelerate gradually and with minimum damage to the vehicle and minimum risk to its occupants.

Current standard arrays employ sand containers having weights of 200, 400, 700, 1400, and 2100 pounds. Customarily, spacers or lightweight supports are provided at the base of the barrel so that the center of gravity of the barrier unit is about the same as that of the errant vehicle, i.e. about two feet above the ground. This prevents the errant vehicle from either ramping or climbing over the units on collision or from nosing under the units. Presently, there are three primary methods for elevating the sand mass in a container. A first method, described in U.S. Pat. No. 3,606,258 to Fitch, utilizes a round Styrofoam pedestal or core at the bottom of a container. To obtain barrels having varying weights, the size of the core may be increased or reduced and/or the amount of sand used to fill the void in the barrel not occupied by the core may be varied. Alternatively, the Fitch '258 patent discloses in FIGS. 12 and 13 an embodiment comprising a crushable base or pedestal section topped by a second section comprising a sand-fillable container. A second method, described in U.S. Pat. No. 4,289,419 to B. C. Young, employs an inverted U-shaped plastic support structure disposed at the bottom of the container. As shown particularly in FIG. 7 of that patent, the weight of the containers may be varied by using variously sized plastic support structures or cores to reduce or increase the interior volume of the container which is available for filling with sand.

Yet a third method, which is in primary use today, is described in U.S. Pat. No. 4,688,766 to Zucker. This method employs a plastic disc or core member 20 of a single size, which is supported on a flange disposed on the outer container. When a container having a weight of 200, 400, or 700 pounds is desired, the core is placed within the container in an upside-down configuration, as illustrated in FIGS. 2A–2C of the patent, and the proper amount of sand, according to provided markings, to achieve the desired weight, is introduced into the available reduced volume within the container. When a weight of 1400 pounds is desired, on the other hand, the orientation of the core is reversed, as illustrated in FIG. 3A of the patent, in order to increase the available volume of the container, which is filled with a greater amount of sand. Finally, when a weight of 2100 pounds is desired, as illustrated in FIG. 3B of the patent, the core is removed completely, and the container is completely filled with sand.

Each of the state-of-the art inertial barrier constructions has disadvantages. The system disclosed in the Fitch '258 patent is disadvantageous in that Styrofoam pedestals or cores of differing sizes must be used for each desired weight configuration, and varying levels of sand must be utilized as well. This is labor intensive and relatively complex, involving the maintenance of an inventory of variously sized core elements. Furthermore, the containers all have identical external configurations, regardless of their weight, making ready identification difficult. As a result, external markings, using spray paint, for example, must be utilized to externally identify the weight of a particular container.

The system disclosed in the Young patent '419 is similarly disadvantageous in that plastic support structures or cores of differing sizes must be used for each desired weight configuration, though at least the available volume in each container is filled in each instance, and there is no need to involve road crew personnel in partially filling containers to various levels. Again, the containers all have an identical appearance from the outside, making identification of the particular weight of a container difficult unless it is marked.

The Zucker patent '766 is an improvement over both Fitch and Young, in that only a single sized core is employed for each of the desired weight configurations. However, the system is still disadvantageous in that the exterior appearance of the container is identical no matter what weight configuration is being employed. Additionally, because the sand mass within the container is elevated, in all but the 2100 pound embodiment, and the bottom of the container is tapered, having a smaller diameter than the top portion, the container is hard to move, because it is unstable. Furthermore, if such a container is utilized on uneven ground, the aforementioned tapering can cause bowing of the container wall.

What is needed, therefore, is an impact attenuator configuration having as few pieces as possible, wherein when the sand mass contained therein is elevated, the exterior sidewall of the attenuator container is at least as wide at its bottom portions as it is at its upper portions. Furthermore, it would be advantageous for such a system to be configured so that containers of varying weights have distinctive external appearances, so that the weight of a particular container may be readily discerned by inspecting its external configuration.

SUMMARY OF THE INVENTION

The present invention addresses the foregoing problems by providing an inertial barrier system comprised of inertial barriers formed of two modules, each of them being differently sized and being adapted to stack one upon the other. An interlocking geometry on each of the mating ends of modules assists in obtaining a secure stacking arrangement. One of the two modules functions as a container, facing upwardly so that its volumetric capacity is available for filling by a particulate ballasting material. The lower module functions only as a pedestal for the support of the upper module. The upper module is advantageously fillable to different predetermined levels, so that the apparatus, comprising the joined lower and upper modules, is capable of functioning as differently weighted barrier systems.

Other advantages of the invention include a system having a minimum number of individual parts, the elimination of a sand platform which can leak sand to lower portions of the barrier, and a large diameter base for the barrier in any configuration, in order to resist tipping of the barrier.

More particularly, there is provided an inertial barrier for protecting a vehicle from a roadway hazard, which comprises a container having an outer sidewall and an interior volume, and a mating end, and which further comprises a pedestal having an outer sidewall and a mating end. The pedestal of the combination is adapted to mate with and support the container in a vertical stacking orientation to together form said inertial barrier. Each of the pedestal and container mating ends includes a projecting portion, and the other of the pedestal and container mating ends includes a recess portion which is complementary to the projecting portion. Thus, when the container and the pedestal are joined together in the aforementioned vertical stacking orientation, the projecting portion is engaged into the recess portion to form an interlocking relationship between the container and the pedestal.

Preferably, the container further comprises an open end which communicates with the interior volume thereof, so that the container interior volume may be filled with a dispersible ballasting material, such as sand. Additionally, the container comprises a lip circumferentially disposed about the open end thereof, and the barrier further comprises a lid for covering the exposed open end of the container, with the lip engaging the lid to secure the lid in a closed position.

The pedestal preferably also comprises an open end, which comprises a base of the barrier. The barrier has an axial height, and the pedestal has a width at least equal to the width of the barrier at any other location along said axial height. In a preferred embodiment, the barrier, at an axial location where the mating ends of each of the container and the pedestal are joined, has a width smaller than the width at the barrier base.

In an advantageous feature of the invention, a portion of the outer sidewall of the pedestal forms an inwardly tapered conic section, in order to provide increased strength in compression for the barrier in the vicinity of the respective mating ends of each of the pedestal and the container, where the width (diameter) is smaller. This inwardly tapered conic section has been found to greatly improve the performance of the pedestal in supporting a filled container without collapsing at the narrower joint of the two mating ends, while still permitting an overall barrier construction having increased stability because of the wider base of the pedestal.

In another aspect of the invention, an inertial barrier for attenuating the energy of an errant vehicle is provided, which comprises a pedestal and a container disposed on the pedestal in a vertical stacking relationship to form a frangible barrier. Each of the container and the pedestal advantageously have an interlocking geometry at a joint therebetween, to prevent sidewards movement between the container and the pedestal, and to maximize performance of the barrier upon impact by a vehicle.

In still another aspect of the invention, there is provided a pedestal for use in an inertial barrier combination for attenuating the energy of an errant vehicle. The pedestal comprises an outer sidewall and a mating end which is adapted to mate with a container in a vertical stacking orientation to together form the inventive inertial barrier combination, wherein the pedestal supports the container. Advantageously, there is interlocking geometry disposed on the mating end of the pedestal, so that when the pedestal is joined with the container, the interlocking geometry engages complementary interlocking geometry on a mating end of the container to secure the pedestal and the container together.

In yet another aspect of the invention, there is provided a container for use in an inertial barrier combination for attenuating the energy of an errant vehicle. The container comprises an outer sidewall and a mating end, wherein the mating end is adapted to mate with a pedestal in a vertical stacking orientation to together form the inventive inertial barrier combination, with the pedestal supporting the container. Advantageously, there is interlocking geometry disposed on the mating end of the container, so that when the pedestal is joined with the container, the interlocking geometry engages complementary interlocking geometry on a mating end of the pedestal to secure the pedestal and the container together.

In another aspect of the invention, there is provided an inertial barrier system for protecting vehicles from a roadway hazard. This inventive system comprises a plurality of inertial barrier units arranged in a predetermined array, wherein at least one of the inertial barrier units comprises a container having an outer sidewall, an interior volume, and a mating end, as well as a pedestal having an outer sidewall and a mating end. The pedestal is adapted to mate with and support the container in a vertical stacking orientation to together form the inertial barrier unit. Advantageously, one of the pedestal and container mating ends includes a projecting portion, and the other of the pedestal and container mating ends includes a recess portion which is complementary to the projecting portion, so that when the container and the pedestal are joined together in the aforementioned vertical stacking orientation, the projecting portion is engaged into the recess portion to form an interlocking relationship between the container and the pedestal.

Preferably, in the inventive system, a plurality of the inertial barrier units comprise the two-piece type described above, having both a container and a pedestal. The containers of these multi-piece inertial barrier units are filled to varying levels with a dispersible ballasting material, resulting in inertial barrier units of varying weights, in a predetermined arrangement.

The invention, together with additional features and advantages thereof, may best be understood by reference to the following description taken in conjunction with the accompanying illustrative drawing.

DESCRIPTION OF THE PREFERRED EMBODIMENT

Figure 1:
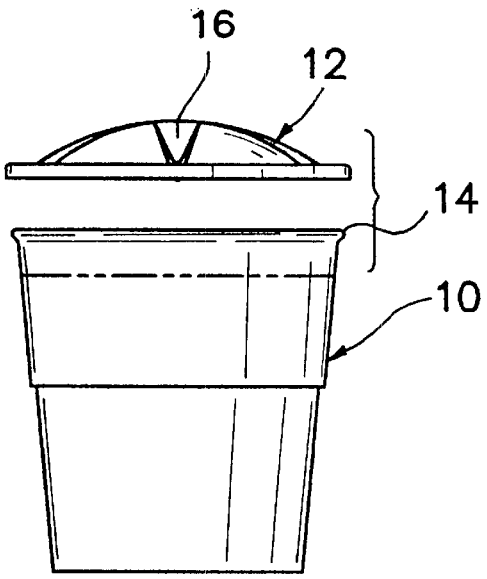
FIG. 1 is an exploded side plan view illustrating a one-piece inertial barrier container and lid of the present invention, for use in 1400 and 2100 pound configurations.
Figure 4:
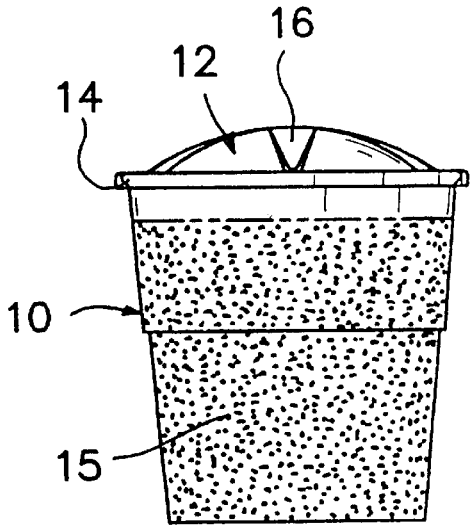
FIG. 4 is a cross-sectional view of the inertial barrier container illustrated in FIG. 1, assembled and filled with a particulate media such as sand.
Figure 8:
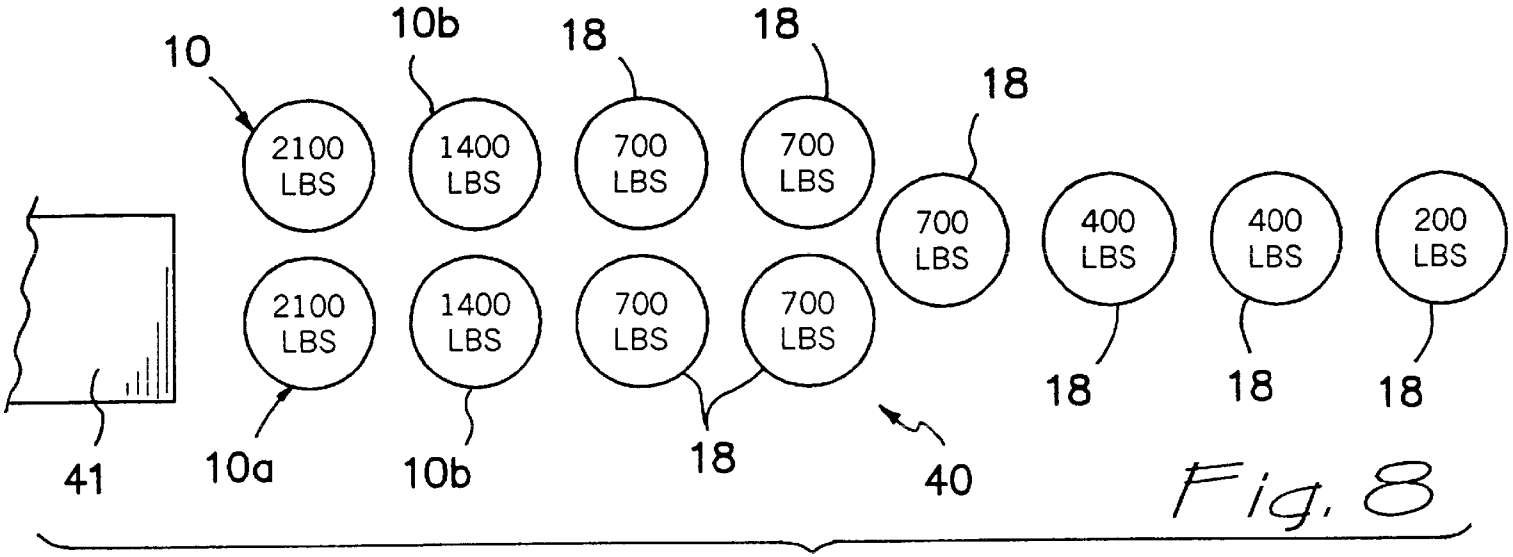
FIG. 8 is a schematic frontal view illustrating a typical array of both one and two-piece inertial barrier containers which may be employed in front of a traffic hazard, such as a bridge abutment, in order to attenuate a crash by an errant vehicle.
Figure 9:
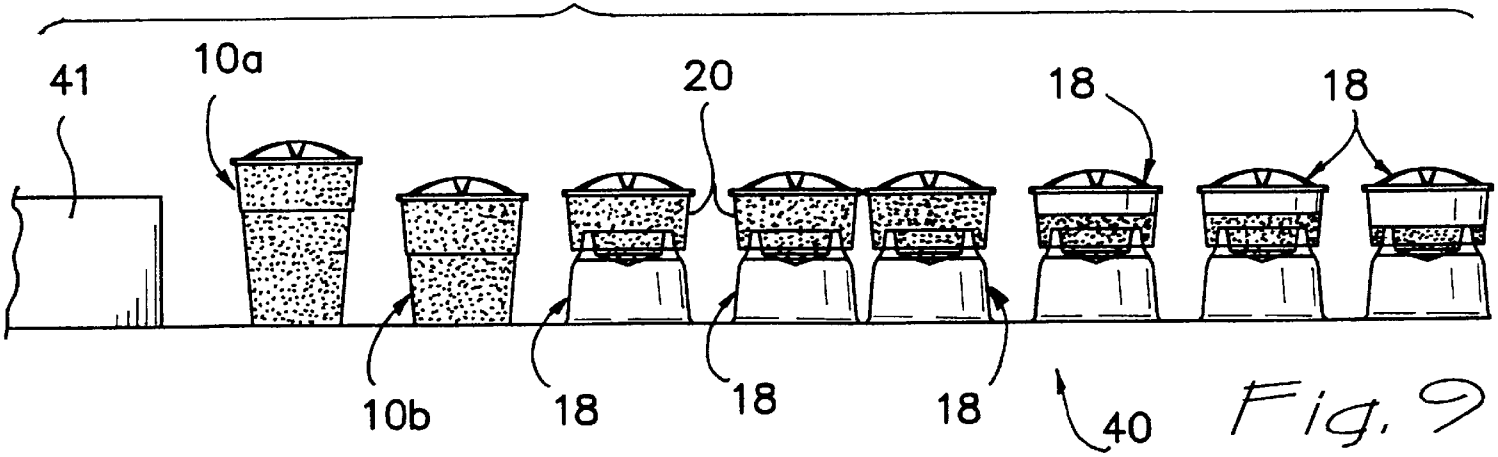
FIG. 9 is a schematic top view of the array illustrated in FIG. 8.

Referring now more particularly to the drawings, FIG. 1 illustrates a one-piece inertial barrier container 10, which is fabricated of a known lightweight, frangible material, such as plastic, using a known inexpensive molding process, such as rotomolding or injection molding. Such a container 10, which includes a lid 12 and a lip 14 for retaining the lid 12 in a closed position, is useful in a crash attenuation array as illustrated in FIGS. 8 and 9 for providing barriers of higher weight, because of its large internal volume. For example, the container 10 may be partially filled, to a fill line molded or marked on the internal sidewall of the container, with a particulate material, such as sand 15, in order to achieve a particular barrier weight, such as 1400 pounds. Alternatively, the same container 10 may be completely filled, as illustrated in FIG. 4, in order to achieve a higher barrier weight, such as 2100 pounds. Another, presently preferred option, as illustrated in FIG. 9, is to employ a larger container 10*a*, completely filled with sand, for a first particular barrier weight, such as 2100 pounds, and to employ a smaller container 10*b*, constructed in a substantially identical fashion, completely filled with sand, for a second particular barrier weight, such as 1400 pounds.

Figure 1A:
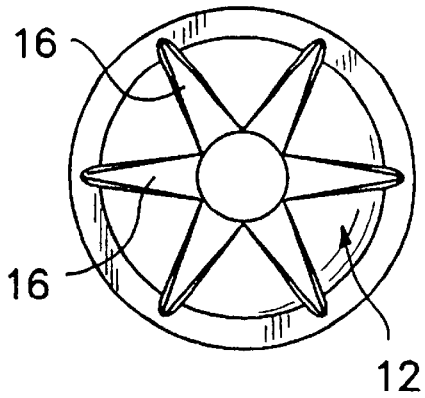
FIG. 1A is a top plan view of a lid for an inertial barrier container constructed in accordance with the principles of the present invention.

The lid 12 is molded in a domed configuration, and includes a plurality of molded tapered recesses 16 (FIG. 1A) for increasing the rigidity of the lid and for resisting crushing of the lid under heavy loading, such as in severe snow conditions.

Now with reference to FIGS. 2, 3, and 5–7, a first preferred embodiment of a two piece inertial barrier unit 18, constructed in accordance with the principles of the invention, is illustrated. In this embodiment, the unit 18 comprises an upper container 20 and a lower pedestal 22, which may be referred to as upper and lower modules, and are adapted to be interlocked vertically to form the unit 18. Each of the container 20 and pedestal 22 are fabricated of a known frangible material, such as plastic, and constructed using known molding techniques, such as rotomolding or injection molding. The upper container 20 has an outer cylindrical sidewall 24, which defines a hollow interior volume for containing a dispersible ballasting material 15, such as sand. The lower pedestal 22 is also fabricated to have an outer cylindrical sidewall 26, which provides a supporting surface at a lower flange or lip 27, for supporting the unit. The sidewall 26 defines a hollow volume which provides a crushable space in the event of a vehicle impact. In the preferred embodiment, the pedestal 22 has a greater height than the container 20, and thus a larger interior volume, but various relative sizes, including those wherein the pedestal had a smaller height than the container, could be employed, depending upon the intended application, and the type of vehicles which are expected to primarily travel the roadways in which the unit 18 is utilized. The design considerations are largely related to a desire to sufficiently elevate the container portion 20 so that a vehicle impact will result in substantial slowing of the vehicle with minimal damage thereto, in order to protect the occupants. The ideal configuration of the unit 18 will vary with the size of the vehicle involved in the impact.

Figure 2:
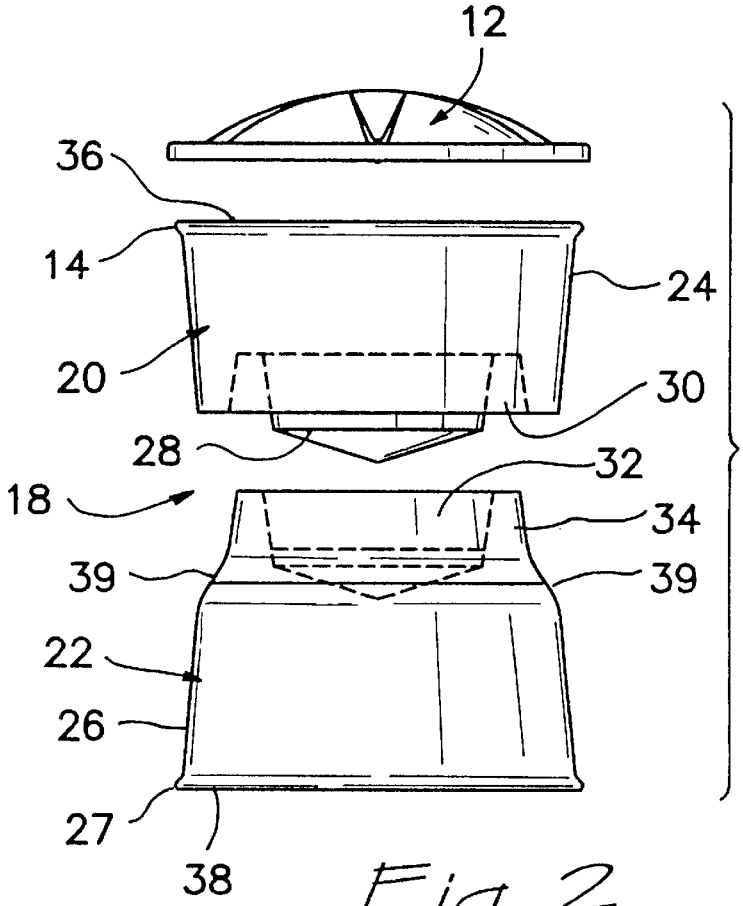
FIG. 2 is an exploded side plan view similar to that of FIG. 1, illustrating a preferred embodiment of a two-piece inertial barrier container and lid constructed in accordance with the principles of the present invention, which may be arranged to accommodate 200 pound, 400 pound, and 700 pound configurations, for example.
Figure 3:
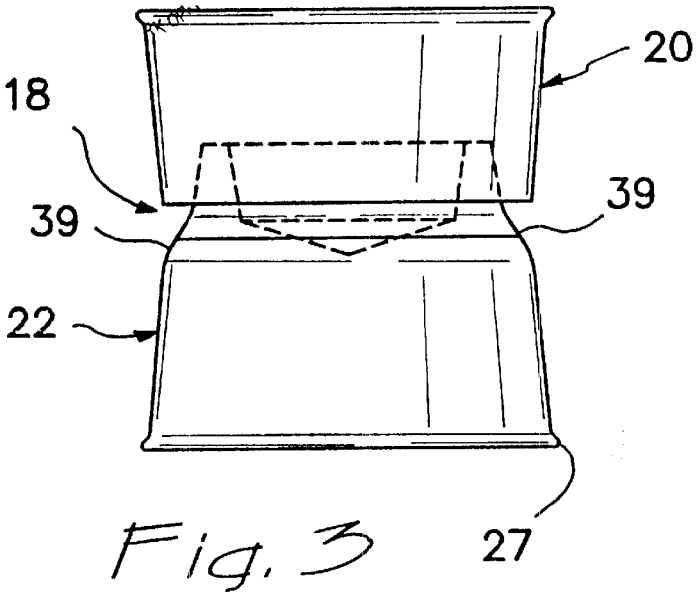
FIG. 3 is a side plan view illustrating the two-piece inertial barrier container of FIG. 2 in an assembled mode.

In the preferred embodiment of FIG. 2, the container 20 comprises a cylindrical center projection 28 which is surrounded by an annular recess 30. The pedestal 22 comprises a cylindrical center recess 32, which is complementary to the cylindrical center projection 28, and is bounded by an annular projection or ridge 34 which is complementary to the annular recess 30, so that the container and pedestal 20 and 22, respectively, effectively mate by being joined together such that the center projection 28 is inserted fully into the center recess 32 and the annular ridge 34 is, of course, simultaneously inserted fully into the annular recess 30, as illustrated in FIGS. 3 and 5–7. The recess 32 has sufficient depth that, when fully mated, and particularly when subsequently filled with sand, the resultant unit 18, comprised of the assembled portions 20 and 22, is extremely stable and highly resistant to tipping or separation absent an impact by a vehicle.

In the preferred embodiment, the container 20 and the pedestal 22 each have open ends, designated as 36 and 38, respectively (FIG. 2), which are wider than their mating ends. On the container 20, the lip 14 accommodates and secures a lid 12 for selectively closing the open end 36. The lower flange 27 on the pedestal 22, on the other hand, is preferably fabricated to be too large to accommodate the lid 12, in order to ensure that workers in the field do not mistakenly attempt to use the pedestal 22 as a sand container.

The arrangement of the mated container and pedestal 20 and 22, respectively, is highly stable. This stability is the result of an effective mating engagement between the two pieces, and also because the open ends 36 and 38 of each of the pieces 20, 22, respectively, are of substantially equal width with respect to one another. The sidewalls of each of the container 20 and the pedestal 22 taper inwardly as they extend axially from their respective open ends. Thus, the open end of the pedestal 22 is at least as wide (radially) as any other portion of the container 18 along its axial height, and significantly wider than the center portion of the axial height of the container, as illustrated in FIGS. 3, 5, 6, and 7.

Figure 5:
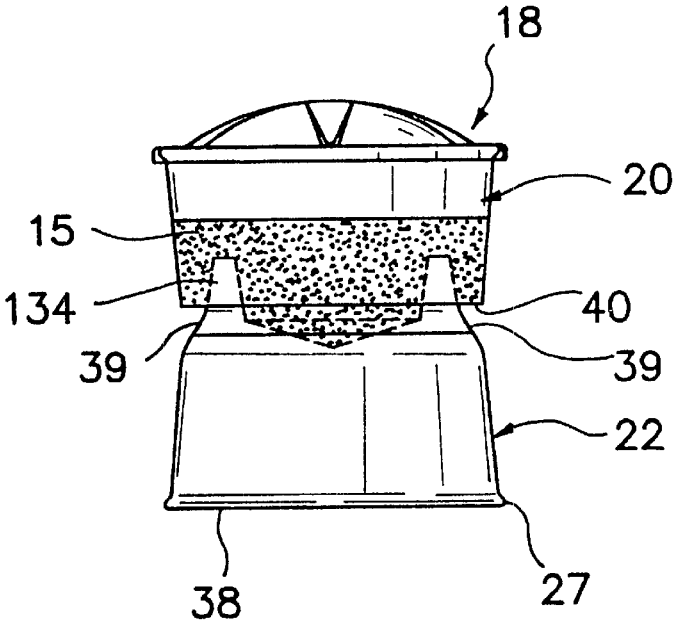
FIG. 5 is a cross-sectional view of the embodiment illustrated in FIGS. 2 and 3, showing a first arrangement of the two-piece configuration for accommodating a particular quantity of sand.
Figure 6:
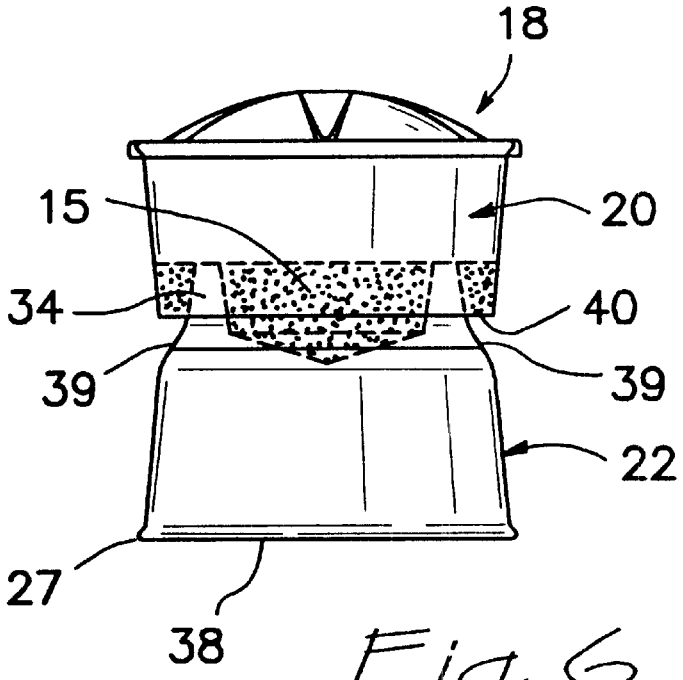
FIG. 6 is a cross-sectional view, similar to that of FIG. 5, of the embodiment illustrated in FIGS. 2 and 3, showing a second arrangement of the two-piece configuration for accommodating a second particular quantity of sand.
Figure 7:
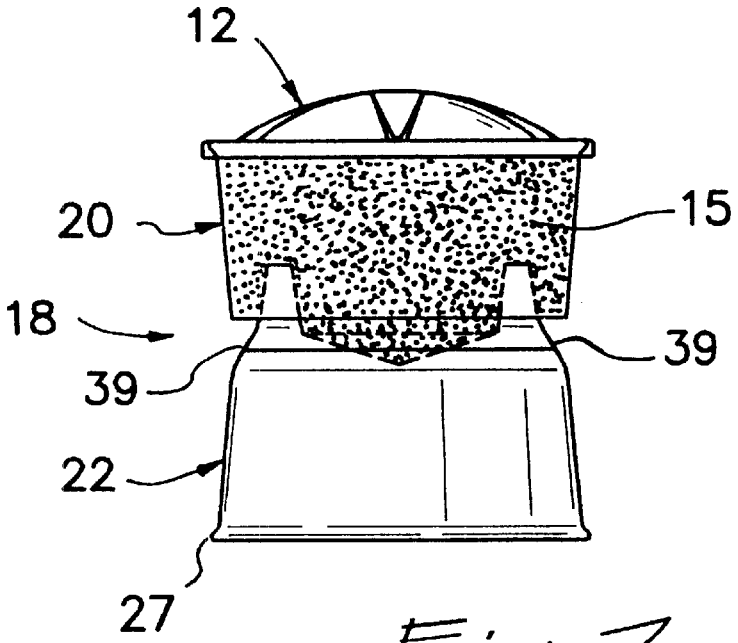
FIG. 7 is a cross-sectional view, similar to that of FIGS. 5 and 6, of the embodiment illustrated in FIGS. 2 and 3, showing a third arrangement of the two-piece configuration for accommodating a third particular quantity of sand.

FIGS. 5–7 illustrated the assembled container 18 filled with sand 15 to each of three different levels, in order to achieve each of three different desired container weights for a typical array. Of course, it is noted at this juncture that the size of the container 20 could be changed, or any other level of sand could be utilized, to vary the weight, if desired, of the unit 18, but the three weights shown are the present standards in the industry. As shown in FIG. 5, the sand 15 fills the interior chamber of the container 20 to a particular denoted fill line which results in a container weight of approximately 400 pounds. Alternatively, as shown in FIG. 6, a worker may fill the chamber to a level equal to the top of the annular ridge 34, which will result in the barrier having a weight of about 200 pounds. FIG. 7 illustrates a filled container 20, which results in a barrier weight of approximately 700 pounds.

An advantageous feature of the invention, as shown in FIGS. 2, 3, and 5–7, is the incorporation of an axially tapered sidewall portion 39 about the circumference of the pedestal 22. The inventor has found that this tapered conic section 39 provides substantially more strength in compression than does a horizontal sidewall step when transitioning the sidewall 26 of the pedestal from the larger diameter open end 38 to the smaller diameter mating end. This additional compression strength is important particularly when the container 20 is completely filled with sand 15.

An inertial barrier array 40 for stopping errant vehicles can be constructed by employing progressively more massive containers, as illustrated in FIGS. 8 and 9. As illustrated, the heaviest container 10*a* is typically employed at a location nearest the obstruction 41 to be protected, such as a bridge abutment. Thus, the two side-by-side containers 10*a* of FIGS. 8 and 9 are completely filled with sand 15 so that they weigh approximately 2100 pounds. Next, the second heaviest containers 10*b* are employed, which are identical to the containers 10*a* in construction, but are of a smaller size, so that when filled with sand 15 they weigh about 1400 pounds. These containers 10*b* are also employed in a side-by-side configuration. In FIG. 11 is shown the next barrier unit 18 to be employed, wherein the container portion 20 is completely filled with sand (FIG. 7) so that the barrier unit 18 weights about 700 pounds. Two of these units are also preferably deployed in a side-by-side arrangement, as shown in FIG. 8. Another set of two 700 pound units are deployed in front of the first set, as also shown in FIG. 8.

Then, in front of the second set of 700 pound barrier units 18, is preferably deployed a single 700 pound barrier unit 18, again as shown in FIG. 8. In front of the single 700 pound unit are deployed two single 400 pound units 18, partially filled with sand as shown in FIG. 5, and a frontmost single 200 pound unit 18, partially filled with sand to a lower level, as shown in FIG. 6. Thus, an errant vehicle will initially strike the lightest container 18, which will shatter but begin to reduce the momentum of the vehicle while minimizing damage thereto. Then, the next lightest container 18, of 400 pounds, will be impacted, further reducing the vehicle's momentum, but still minimizing damage to the vehicle because of its relatively light weight and the slower speed of the vehicle. As the vehicle continues to slow, it will impact heavier and heavier containers in order to more quickly reduce its momentum, but damage to the vehicle will still be limited because of its slower speed and the frangible nature of the containers. Finally, assuming the vehicle's initial impact was at a relatively high speed, and the vehicle was relatively heavy, the container 10*a* will be impacted by a much slowed vehicle, which will hopefully then be fully stopped without injury to the occupants before impact with the bridge abutment or other immovable obstacle 41.

Of course, while the array of FIGS. 8 and 9 is illustrated by way of example, any desired array of containers 10*a*, 10*b*, and/or units 18 may be utilized, as desired, in order to provide a suitable protection from impact with obstacles such as bridge abutments and the like.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. An inertial barrier for protecting a vehicle from a roadway hazard, comprising:

a container having an outer sidewall, an interior volume, an open end for receiving ballasting material into said interior volume, and a mating end; and a pedestal having an outer sidewall and a mating end, the pedestal being adapted to mate with and support the container in a vertical stacking orientation, with said container disposed atop and above an upper portion of said pedestal, and said open end being uppermost on said container, to together form said inertial barrier;

wherein one of the pedestal and container mating ends includes a projecting portion, and the other of the pedestal and container mating ends includes a recess portion which is complementary to said projecting portion, so that when said container and said pedestal are joined together in said vertical stacking orientation, with said container disposed atop said pedestal, said projecting portion is engaged into said recess portion to form an interlocking relationship between the container and the pedestal.

2. The inertial barrier as recited in claim 1, wherein each of said container and said pedestal is comprised of a frangible material.

3. The inertial barrier as recited in claim 1, wherein said ballasting material comprises a dispersible particulate material.

4. The inertial barrier as recited in claim 3, wherein said dispersible particulate material comprises sand.

5. An inertial barrier for protecting a vehicle from a roadway hazard, comprising:

a container having an outer sidewall, an interior volume, a mating end, and an open end which communicates with the interior volume of the container, so that the container interior volume may be filled with a ballasting material; and a pedestal having an outer sidewall and a mating end, the pedestal being adapted to mate with and support the container in a vertical stacking orientation, with said container disposed atop and above an upper portion of said pedestal to together form said inertial barrier;

wherein one of the pedestal and container mating ends includes a projecting portion, and the other of the pedestal and container mating ends includes a recess portion which is complementary to said projecting portion, so that when said container and said pedestal are joined together in said vertical stacking orientation, with said container disposed atop said pedestal, said projecting portion is engaged into said recess portion to form an interlocking relationship between the container and the pedestal, said container further comprising a lip circumferentially disposed about the open end thereof, said barrier further comprising a lid for covering the open end of said container, said lip engaging said lid to secure the lid in a closed position.

6. An inertial barrier for protecting a vehicle from a roadway hazard, comprising:

a container having an outer sidewall and an interior volume, and a mating end; and a pedestal having an outer sidewall and a mating end, the pedestal being adapted to mate with and support the container in a vertical stacking orientation, with substantially all of said container being disposed atop substantially all of said pedestal, to together form said inertial barrier;

wherein one of the pedestal and container mating ends includes a projecting portion, and the other of the pedestal and container mating ends includes a recess portion which is complementary to said projecting portion, so that when said container and said pedestal are joined together in said vertical stacking orientation, with said container disposed atop said pedestal, said projecting portion is engaged into said recess portion to form an interlocking relationship between the container and the pedestal;

said pedestal further comprising an open end, which comprises a base of said barrier at a lowest end thereof when said barrier is assembled in said vertical stacking orientation, said barrier having an axial height and said pedestal having a width at least equal to the width of said barrier at any other location along said axial height.

7. The inertial barrier as recited in claim 6, wherein the barrier at an axial location where the mating ends of each of the container and the pedestal are joined has a width smaller than the width at said barrier base.

8. An inertial barrier for protecting a vehicle from a roadway hazard, comprising:

a container having an outer sidewall and an interior volume, and a mating end; and a pedestal having an outer sidewall and a mating end;

the pedestal being disposed on a surface, with its mating end being an upper end thereof and the container being disposed on the mating end of said pedestal, the container mating end being a lower end of the container and being engaged with the pedestal mating end to together form said inertial barrier, substantially all of said container being disposed in a vertical stacking orientation above an upper portion of said pedestal;

wherein one of the pedestal and container mating ends includes a projecting portion, and the other of the pedestal and container mating ends includes a recess portion which is complementary to said projecting portion, so that when said container and said pedestal are joined together in said vertical stacking orientation, said projecting portion is engaged with said recess portion to form an interlocking relationship between the container and the pedestal.

9. A container for use in an inertial barrier combination for attenuating the energy of an errant vehicle, comprising:

an outer sidewall;

a mating end; which is adapted to mate with a pedestal in a vertical stacking orientation to together form said inertial barrier combination, wherein the pedestal supports the container; and interlocking geometry on said mating end, so that when said container is joined with said pedestal, with said container being disposed atop said pedestal, said interlocking geometry engages complementary interlocking geometry on a mating end of said pedestal to secure the pedestal and the container together, wherein said mating end comprises a projecting portion and a recess portion, each of which are adapted to engage complementary recess portions and projecting portions on a mating end of the container.

10. An inertial barrier for protecting a vehicle from a roadway hazard, comprising:

a container having an outer sidewall, an interior volume, and a mating end; and a pedestal having an outer sidewall and a mating end, the pedestal being adapted to mate with and support the container in a vertical stacking orientation, with said container disposed atop said pedestal to together form said inertial barrier;

wherein the mating end of each of said container and said pedestal comprises both a projecting portion and a recess portion, such that when the pedestal and the container are stacked together in said vertical stacking orientation, the projecting portion of the container is inserted into the recess portion of the pedestal, and the projecting portion of the pedestal is inserted into the recess portion of the container, the respective projecting and recess portions of each of the container and the pedestal being complementarily shaped.

11. An inertial barrier for attenuating the energy of an errant vehicle, comprising:

a pedestal; and a container having an interior volume, said container having an end which is capable of receiving ballasting material into said interior volume and being disposed above and atop an upper portion of said pedestal in a vertical stacking relationship to form a frangible barrier, with said ballasting material receiving end being oriented upwardly;

wherein each of the container and the pedestal have au interlocking geometry at a joint therebetween, to prevent sidewards movement between the container and the pedestal.

12. A pedestal for use in an inertial barrier combination for attenuating the energy of an errant vehicle, comprising:

an outer sidewall;

a mating end having a mating surface: which is adapted to mate with a container in a vertical stacking orientation to together form said inertial barrier combination, wherein the pedestal supports the container; and interlocking geometry on said mating end, said interlocking geometry comprising a portion of said mating surface which is disposed at a different elevation than remaining portions of said mating surface, so that when said pedestal is joined with said container, with said pedestal being disposed beneath said container to support the container, said interlocking geometry engages complementary interlocking geometry on a mating end of said container to secure the pedestal and the container together.

13. The pedestal as recited in claim 12, wherein said portion of said mating surface which is disposed at a different elevation than remaining portions of said mating surface comprises a recess relative to said remaining portions.

14. The pedestal as recited in claim 12, and further comprising an open end which forms a base of said pedestal.

15. The pedestal as recited in claim 12, wherein said portion of said mating surface which is disposed at a different elevation than remaining portions of said mating surface comprises a projection relative to said remaining portions.

16. A container for use in an inertial barrier combination for attenuating the energy of an errant vehicle, comprising:

an outer sidewall;

a mating end; which is adapted to mate with a pedestal in a vertical stacking orientation to together form said inertial barrier combination, wherein the pedestal supports the container;

a ballasting material receiving end, opposite of said mating end; and interlocking geometry on said mating end, so that when said container is joined with said pedestal, with said container being disposed atop and above an upper portion of said pedestal, said interlocking geometry engages complementary interlocking geometry on a mating end of said pedestal to secure the pedestal and the container together, and said ballasting material receiving end is disposed in an upwardly oriented direction.

17. A pedestal for use in an inertial barrier combination for attenuating the energy of an errant vehicle, comprising:

an outer sidewall;

a mating end; which is adapted to mate with a container in a vertical stacking orientation to together form said inertial barrier combination, wherein the pedestal supports the container; and interlocking geometry on said mating end, so that when said pedestal is joined with said container, with said pedestal being disposed beneath said container to support the container, said interlocking geometry engages complementary interlocking geometry on a mating end of said container to secure the pedestal and the container together, wherein said mating end comprises a projecting portion and a recess portion, each of which are adapted to engage complementary recess portions and projecting portions on a mating end of the container.

18. A container for use in an inertial barrier combination for attenuating the energy of an errant vehicle, comprising:

an outer sidewall;

a mating end, which is adapted to mate with a pedestal in a vertical stacking orientation to together form said inertial barrier combination, wherein the pedestal supports the container;

an open end which communicates with an interior volume of said container, said interior volume being fillable with a dispersible ballasting material through said open end;

interlocking geometry on said mating end, so that when said container is joined with said pedestal, with said container being disposed atop said pedestal, said interlocking geometry engages complementary interlocking geometry on a mating end of said pedestal to secure the pedestal and the container together; and a lip circumferentially disposed about the open end thereof, said container further comprising a lid for covering the exposed open end of said container, said lip engaging said lid to secure the lid in a closed position.

19. An inertial barrier system for protecting vehicles from a roadway hazard, comprising:

a plurality of inertial barrier units arranged in a predetermined array, at least one of said inertial barrier units being of a multi-piece type comprising:

a container having an outer sidewall, an interior volume, and a mating end; and a pedestal having an outer sidewall and a mating end, the pedestal mating with and supporting the container in a vertical stacking orientation to together form said inertial barrier unit;

wherein one of the pedestal and container mating ends includes a projecting portion, and the other of the pedestal and container mating ends includes a recess portion which is complementary to said projecting portion, so that when said container and said pedestal are joined together in said vertical stacking orientation, with said container being disposed atop and above an upper portion of said pedestal, so that substantially all of said container is disposed above substantially all of said pedestal, said projecting portion is engaged into said recess portion to form an interlocking relationship between the container and the pedestal.

20. The inertial barrier system as recited in claim 19, wherein a plurality of said inertial barrier units are of said multi-piece type.

21. The inertial barrier system as recited in claim 20, wherein the containers of said multi-piece inertial barrier units are filled to varying levels with a dispersible ballasting material, resulting in inertial barrier units of varying weights.

* * * * *